US005343176A

United States Patent [19]

Hasler

[11] Patent Number: 5,343,176

[45] Date of Patent: Aug. 30, 1994

[54] RADIO FREQUENCY FILTER HAVING A SUBSTRATE WITH RECESSED AREAS

[75] Inventor: Raymond J. Hasler, Milton Malsor, United Kingdom

[73] Assignee: Applied Radiation Laboratories, Northants, England

[21] Appl. No.: 15,908

[22] Filed: Feb. 10, 1993

[30] Foreign Application Priority Data

Aug. 10, 1992 [GB] United Kingdom ..... 9216915.0

[51] Int. Cl.[5] ..... H01P 1/203; H01P 3/08

[52] U.S. Cl. ..... 333/204; 333/205; 333/246

[58] Field of Search ..... 333/204, 205, 219, 235, 333/246, 238, 247

[56] References Cited

U.S. PATENT DOCUMENTS

| | | | |
|---|---|---|---|
| Re. 31,470 | 12/1983 | Bedard et al. | 333/204 |
| 3,879,690 | 4/1975 | Golant et al. | 333/204 |
| 4,157,517 | 6/1979 | Kneisel et al. | 333/205 |
| 4,288,530 | 9/1981 | Bedard et al. | 333/205 X |
| 4,551,696 | 11/1985 | Moutrie et al. | 333/204 |
| 4,609,892 | 9/1986 | Higgins, Jr. | 333/204 |
| 4,622,528 | 11/1986 | Millard | 333/205 |
| 4,801,905 | 1/1989 | Becker | 333/246 X |
| 4,894,629 | 1/1990 | Okamura et al. | 333/177 |
| 4,963,843 | 10/1990 | Peckham | 333/203 |
| 5,004,992 | 4/1991 | Grieco et al. | 333/202 |
| 5,014,024 | 5/1991 | Shimizu et al. | 333/203 |
| 5,023,580 | 6/1991 | Kim et al. | 333/206 |
| 5,162,761 | 11/1992 | Kita et al. | 333/204 X |

FOREIGN PATENT DOCUMENTS

| | | | |
|---|---|---|---|
| 0132088 | 7/1984 | European Pat. Off. . | |
| 0112701 | 6/1984 | Japan | 333/247 |
| 0126301 | 7/1984 | Japan | 333/204 |
| 0100002 | 5/1986 | Japan | 333/204 |
| 0284501 | 12/1987 | Japan | 333/238 |
| 0219201 | 9/1988 | Japan | 333/204 |
| 0285001 | 11/1988 | Japan | 333/247 |
| 3261202 | 11/1991 | Japan | 333/247 |
| 4035202 | 2/1992 | Japan | 333/246 |

OTHER PUBLICATIONS

Microwaves & RF–Sep. 1991, pp. 109–114; "Ceramic Filters Serve Microwave Application" by Brian Walker.

IEEE Transactions on Microwave Theory and Techniques, vol. 37, No. 4, Apr. 1989, p. 805; "Conductor Geometry Independence of Phase Velocity in TEM--Mode Transmission Lines" by Harry E. Green.

Microwave Journal–Nov. 1987, pp. 141 to 160; "A Bandpass Filter Using Direct–Coupled Quarter–Wavelength Coaxial Dielectric Resonators" by Kazunori Hano and Ken–Ichi Sawamoto.

Computer–Aided Design of Microwave Circuits by K. C. Gupta, Ramesh Garg and Rakesh Chadha, published by Artech House, Inc., pp. 257 and 258, 1981.

IEEE Transactions on Microwave Theory and Techniques, vol. MTT–18, pp. 278–280, (May 1970); "Microwave Filters of Coupled Lines and Lumped Capacitances" by Reinhold Pregla.

IEEE Transactions on Microwave Theory and Techniques, vol. MTT–18, p. 1029 (1970); "Interdigital Capacitors and Their Application" by Alley.

Proceedings of the IRE (1957), p. 187, "Direct–Coupled–Resonator Filters" by Seymour B. Cohn.

Microwave Engineering Europe–Feb. 1992, pp. 23–28, "Miniaturised Ceramic–Based Components for Cellular Telephones" by T. N. Nishikawa and K. W. Washida.

RF Design, Mar. 1989, "Monolithic Ceramic Block Combline Bandpass Filters" by Darrioush Agahi of Motorola, Inc.

UK Search Report, dated May 23, 1993.

*Primary Examiner*—Seungsook Ham

*Attorney, Agent, or Firm*—Fisher & Associates

[57] ABSTRACT

A radio frequency transmission line filter has an insulative substrate substantially in the form of a plate of dielectric material, a ground plane formed by metallization on one face of the substrate, capacitor plates formed by areas of metallization on the other face of the substrate to form, in conjunction with the ground plane, capacitances, and coupled to the capacitances, respective metallized short circuit transmission line stubs forming inductances. The inductances and capacitances together form transmission line resonators. To allow the designer a wide choice in capacitance and/or inductance values, the substrate is recessed in selected areas to bring the ground plane to within predetermined distances of the capacitor plates or inductance stubs. The ground plane may be trimmed in the recessed areas to adjust component values.

26 Claims, 4 Drawing Sheets

RADIO FREQUENCY FILTER HAVING A SUBSTRATE WITH RECESSED AREAS

BACKGROUND OF THE INVENTION

This invention relates to a radio frequency filter and in particular, to a filter constructed for printed circuit board or surface mount applications.

Conventionally, filters in the frequency range 300 MHz to several gigahertz are constructed using so-called quarter-wavelength resonators. Often these are of the so-called "engine block" variety which comprise a series of generally cylindrical transmission line resonators formed from metallized ceramic tubes of less than a quarter-wavelength electrical length, which are coupled to each other by their mutual proximity and via various arrangements of orifices and by removal of the metallization. Another common approach is to form a multi-layer device with inductor spirals formed on a dielectric substrate material coupled to multiple-layer capacitors. The latter approach suffers in particular from poor upper frequency performance limitation imposed by the spiral inductors due to unwanted fringing capacitances in the spirals.

Prior filter constructions in general are complicated to manufacture, requiring several different materials and processes to be used in their construction followed by complex mechanical processes such as lapping and re-plating to trim the filter to meet the required electrical specification. In addition, such filters are frequently the largest component on a circuit board and are not readily reduced in size. Such a reduction in size is desirable not least because this generally causes the spurious response inherent in such filters to move further up the frequency spectrum and thus further away from the spectral area of interest.

SUMMARY OF THE INVENTION

It is an object of the present invention to provide a radio frequency filter which overcomes at least some of the problems associated with prior filters.

According to one aspect of the invention, there is provided a radio frequency filter comprising an electrically insulative substrate substantially in the form of a plate of dielectric material, an electrically conductive ground plane formed on one major face of the plate, and, on the other major face, a metallization pattern, the pattern forming, in conjunction with the ground plane and the substrate, a plurality of interconnected reactive elements, wherein the substrate has a portion of lesser thickness in the region of a part of the metallization pattern associated with at least one of the reactive elements, whereby the metallization pattern and the ground plane are closer together in the said region than in other portions of the substrate. The metallization pattern may include a capacitor plate formed by an area of metallization to form, in conjunction with the ground plane, a capacitance, and coupled to the capacitor plate, a metallized short circuited transmission line section forming an inductance, said inductance and capacitance together forming a transmission line resonator, the substrate portion of reduced thickness being formed in the region of at least one of the capacitor plate and transmission line section. The filter may comprise several such transmission line resonators.

According to another aspect of the invention, a method of manufacturing a radio frequency filter comprises: forming from a dielectric material an electrically insulative substrate substantially in the form of a plate with at least one recess in a major face thereof; depositing on one of the major faces of the substrate a metallization layer to form a ground plane; and depositing on the other major face of the substrate a metallization pattern to form, in conjunction with the ground plane and the substrate, a plurality of interconnected reactive elements; wherein at least one of the ground plane and the metallization pattern extends into said at least one recess.

Preferably, the filter is constructed as a component for printed circuit board mounting, typically as a surface-mount component, for use in applications from VHF to microwave frequencies. The component may be a monolithic device. The substrate may be shared with another device such as an amplifier which may use matching elements formed using thinned substrate portions. By reducing the thickness (thinning) the substrate beneath the capacitor plate prior to plating the ground plane, the distance between the plate and the part of the ground plane beneath the plate is decreased, thereby increasing the capacitance. By selecting the substrate thickness in this way, a filter designer is able to control not only the capacitance value but also the area of the plate. Additionally, since the inductance of a short transmission line section is substantially independent of substrate permittivity, and providing the length of the inductive section remains less than $\lambda_g/4$ (where $\lambda_g$ is the guide wavelength, i.e. the wavelength in the transmission line), the designer is free to choose the dielectric substrate material according to its permittivity to suit the required capacitance largely without affecting the inductance of the line section. Using a thinning technique, the range of realisable element values available to the filter designer is thereby increased, within the constraints of small size and a single substrate.

The filter may be constructed on a ceramic substrate which may be extruded, die-pressed and/or sonic milled in order to obtain thinned portions. (Sonic milling is a machining process in which the substrate material is abraded by abrasive particles suspended in a liquid medium between the end of a vibrating tool face and the substrate. The vibration frequency is typically in the upper audio or ultrasonic frequency ranges.) The recessing may be performed on the ground-plane side of the substrate and/or on the other side.

To reduce the amount of dielectric material used in a filter, and to reduce the weight of the filter, the substrate may be thinned in non-critical areas such as near the inductive line section and in areas not proximal the line section and the capacitance, without degrading the filter response. In fact, it is possible to improve the filter performance by thinning in certain areas. For instance, a connection between one end of the inductive line section and the ground plane is typically achieved using a plated-through hole (a via), to form a short-circuit transmission line stub. This hole exhibits inductance in its own right, but this may be reduced by shortening the via by thinning the substrate around the via. This also serves to reduce unwanted coupling between vias. Furthermore, it is possible to reduce the coupling between neighbouring stubs by providing grooves between them so that the ground conductor layer is nearer the stubs in the intervening region and acts as a partial screen between them. This allows the stubs to be positioned closer together and/or narrows the bandwidth of the filter for a given line spacing. Such grooves may also be used to inhibit unwanted coupling effects of adjacent lines where coupling is not desired.

A further benefit, as described below, is an ability to trim more easily the inductance and capacitance values of a shielded final assembly in order to obtain precisely a required electrical response.

The metallized capacitor plate and stub on the side of the substrate opposite the ground plane are preferably enclosed in a conductive shield. The addition of this shield introduces parasitic capacitances that vary from unit to unit. Additionally, material and etching tolerances also introduce slight variations in the filter characteristics. Each filter may thus need to be trimmed and this may be achieved by laser-trimming or abrading away a portion of the ground plane on a thinned area beneath a patch or patches or a thinned area below an inductive stub or stubs.

Since recesses in the ground plane face of the substrate lift sensitive areas of the capacitance and the adjustable section of the inductive stubs away from the lower extremities of the filter, when the filter is mounted on a printed circuit board the trimmed area is some distance away from the board. This minimises the performance degradation that would otherwise occur upon mounting, i.e. if the trimmed area was not recessed. This trimming operation may also be used in low frequency filters (which require larger capacitance values), by arranging to have a substrate capacitor, as described above, electrically connected in parallel with a conventional "lumped" capacitor. The overall capacitance of the parallel combination may then be adjusted by trimming the substrate capacitor in the manner just described.

It should be noted that the capacitor plate may be formed by a patch of arbitrary shape. Some shapes are preferred for the suppression of higher order modes which occur in microwave filters. Whatever shape is used, the capacitance value produced by the patch is determined by the substrate material and the selective thinning below the patch.

The shield may comprise a metal can or a layer of metallised dielectric material, the latter being bonded on its unmetallised surface to the face of the substrate opposite the ground plane. The shield is preferably connected to ground. By recessing the shield so that parts of its conducting surface are closer to the substrate, parts of the filter may be selectively capacitively coupled to the shield by effectively increasing the parasitic capacitance in selected areas. Since the shield will usually be grounded, the filter component values may be altered in the same manner as recessing of the substrate. Thus the patches and stubs may effectively be sandwiched between two dielectrics each of which has a ground plane on its outer face and each of which may be recessed. In the case of a metal can, the dielectric material is air and the can may be formed with dimple-like recesses which bring parts of the can nearer to the substrate material beneath.

Since the inductance of short stubs depends on the substrate thickness (largely irrespective of substrate permittivity) it is possible to control filter size further by altering the substrate thickness to adjust the size of the inductive stubs whilst maintaining the same capacitance values, by selective thinning.

It may be desirable to insert transmission nulls into the filter response, to provide a steeper roll-off at the edges of a pass-band for instance. These may be achieved by capacitively coupling together selected stubs in a controlled fashion. The coupling may be achieved by connecting a conventional chip capacitor between the stubs. Alternatively, the coupling may be achieved by bonding a "parallel plate" capacitor, formed from an insulator with conductive material, on substantially opposing faces, in a recess formed between two stubs, the conductive material of each face being connected to each stub respectively. In order to avoid adding components, the coupling may be achieved by forming metallized capacitor plates on the sides of a recess between the stubs. These plates may be formed on dielectric blocks projecting into the recess from the recess sides, and conducting tabs may be bonded to the opposing faces of the blocks for adjusting the coupling capacitance. The tabs may be constructed from a ferromagnetic or non-ferromagnetic material.

To suppress unwanted modes in the stubs, the selective thinning beneath the stubs need not produce a recess that is parallel to the upper surface. Typically the recess may have a triangular or wedge-shaped cross-section such that the upper surface of the recess is inclined in relation to the upper surface of the filter.

BRIEF DESCRIPTION OF THE DRAWINGS

These and other objects, advantages and features of the invention will become apparent from the following description of preferred embodiments thereof taken in conjunction with the accompanying drawings, in which.

DESCRIPTION OF THE PREFERRED EMBODIMENTS

In order to design a filter in accordance with the invention, a filter designer may use any preferred method to synthesize the element values required to create the filter transfer function, and may then convert these values into transmission line sections. This is often done using Richards' Transform. With Richards' Transform, open-circuit transmission lines map into capacitors and short-circuit transmission lines realise inductors.

Figure 1:
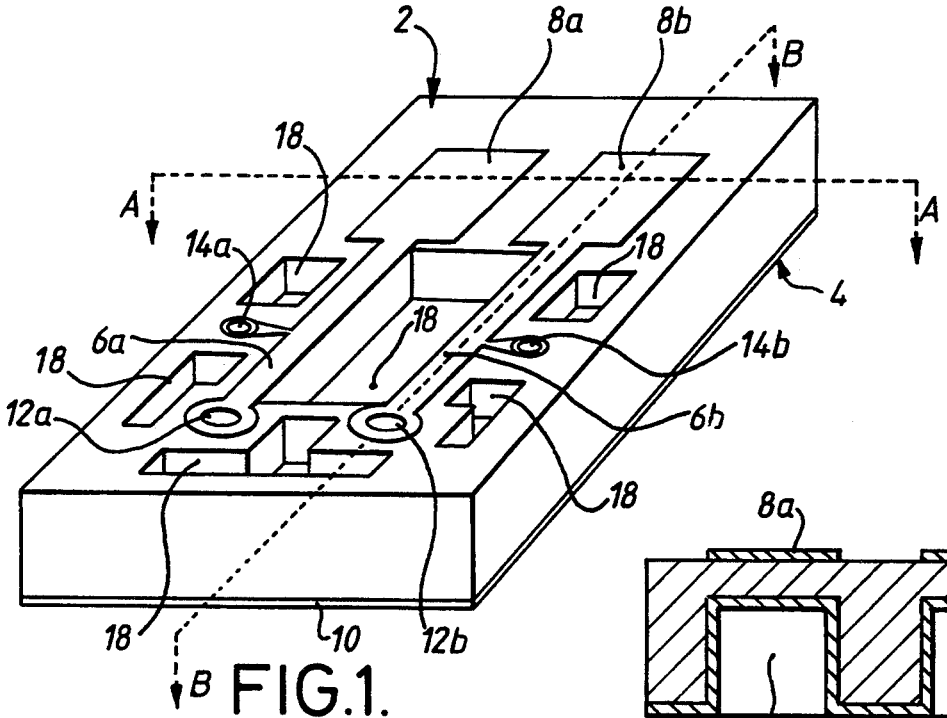
FIG. 1 is a perspective view of a filter constructed in accordance with the invention, viewed from above and from one side.
Figure 2:
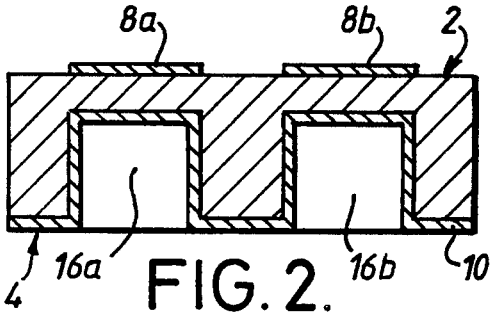
FIG. 2 is a section along line A—A of FIG. 1.
Figure 3:
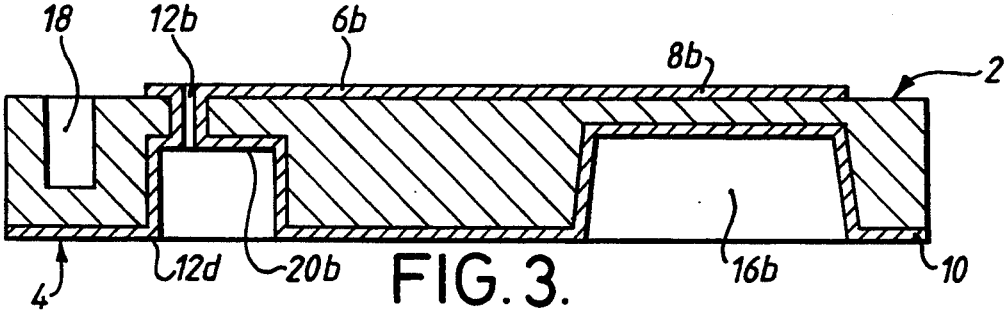
FIG. 3 is a section along line B—B of FIG. 1.
Figure 1A:
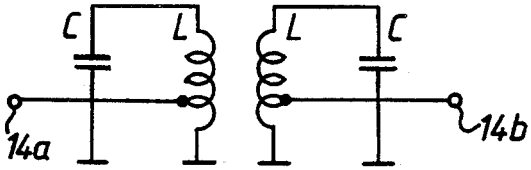
FIG. 1A is a schematic diagram of an equivalent electrical circuit of the filter of FIG. 1.

Referring to FIGS. 1 to 4, a first embodiment of a simple two resonator coupled line filter in accordance with the invention comprises a substrate plate having an upper surface 2 and lower surface 4. An equivalent schematic circuit of the filter is shown in FIG. 1A. Metallized transmission line stubs 6*a*, 6*b* on the upper surface 2 form inductances L and patches 8*a*, 8*b* on the upper surface at an end of each stub 6*a*, 6*b* respectively, form capacitances C in combination with a ground plane 10 formed over the entire lower surface 4. Vias 12*a*, 12*b* at the other ends of stubs 6*a*, 6*b* respectively, serve to connect the stubs to the ground plane. Input and output taps 14*a*, 14*b* are positioned part-way along stubs 6*a*, 6*b* respectively, their position on the stubs determining the Q-factor and impedance matching of the filter. Metallized holes at the ends of the taps 14*a*, 14*b* provide for the attachment of input/output pins which, when the filter is installed, connect to a host PCB. Alternative input/output arrangements are possible, employing microstrip, stripline and/or coplanar waveguide elements to bring the filter connections to metallized surfaces or formed metal legs on the substrate edge for surface mount applications. Portions of the substrate have been selectively thinned beneath patches 8*a*, 8*b* producing recesses 16*a*, 16*b* in the lower surface 4 in order to achieve required capacitance values, the thinning having been performed prior to metallization so that the ground plane 10 covers the surfaces of the recesses 16*a*, 16*b* in the underside of the substrate to bring the ground plane closer to the upper surface of the substrate in the thinned areas.

Additionally, the substrate may be thinned in areas which are not in registry with printed areas of the upper surface to reduce weight and use of the substrate material. Referring to FIG. 1, weight-reducing recesses 18 open out in the upper surface 2 of the substrate.

In this embodiment, selective thinning has also been used to produce recesses 20*a*, 20*b* in the region of the lower ends 12*c*, 12*d* of the vias 12*a*, 12*b*. These are also plated to bring the ground plane 10 nearer the upper surface so as to reduce the inductance of each via 12*a*, 12*b*. These recesses 20*a*, 20*b* have extensions under the inductive stubs 6*a* and 6*b*, conveniently allowing the trimming away of small portion of ground plane metallization in the bases of the recesses 20*a* and/or 20*b* thereby providing for adjustment of the realised inductance value and hence the filter characteristics. The sensitivity to such adjustments may be adjusted by controlling the thickness of the thinned substrate sections formed by recesses 20*a*, 20*b*. Trimming may be by laser trimming or abrasion techniques.

Figure 4:
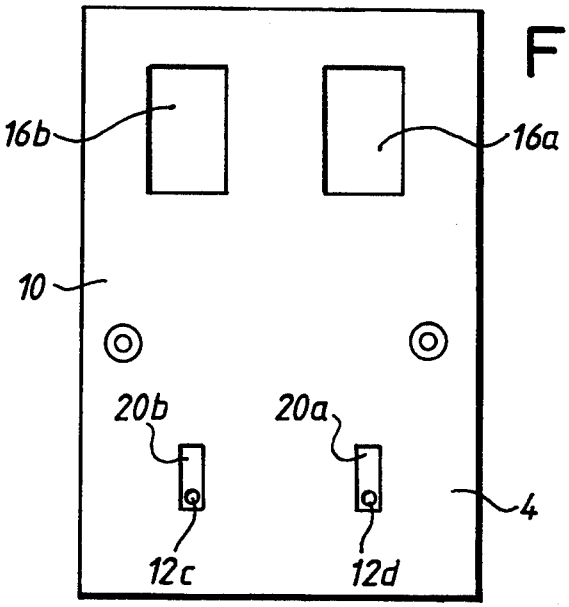
FIG. 4 is an underside plan view of the filter of FIG. 1.

Referring to FIG. 4, a small portion of the ground plane in recesses 16*a*, 16*b* may be removed additionally to trim the filter response by altering the realised capacitor value.

Figure 5:
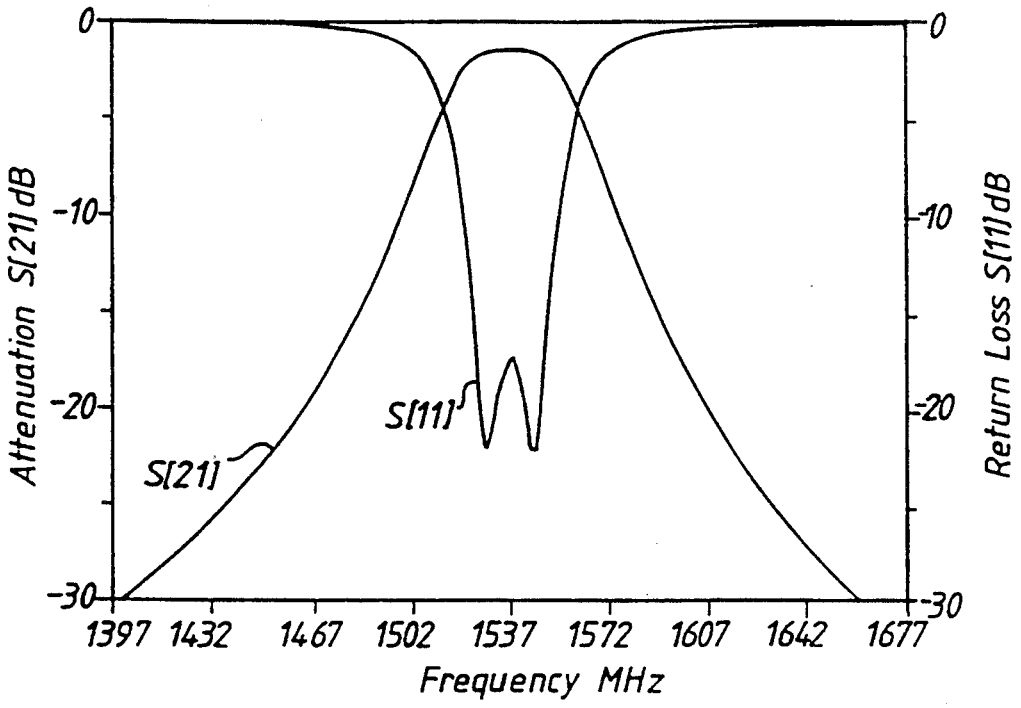
FIG. 5 is a filter response diagram for a typical filter constructed as shown in FIG. 1.

Plots of the attenuation and insertion loss of a typical filter having the features described above with reference to FIGS. 1 to 4 are shown in FIG. 5.

It will be appreciated that the use of selective substrate thinning in accordance with the invention greatly increases the range of inductances and capacitances which may be realised without employing additional discrete components.

Since the inductance of the stubs 6*a*, 6*b* is largely independent of substrate permittivity, the choice of substrate material may be made to achieve required capacitor values independent of inductance.

As a summary of the measures available to the designer it should be noted that:

i) The inductance of a transmission line increases (for a given substrate thickness):

a) if the line width is made smaller, or b) the line length is increased.

Alternatively, by using the substrate thickness as a variable:

c) the inductance of the line increases with increasing substrate thickness.

If the substrate material is non-ferromagnetic then c) is valid irrespective of the substrate material permittivity.

ii) The capacitance of a transmission line increases (for a given substrate thickness)

a) if the line width is increased;

b) if the line length is increased; or c) if the substrate permittivity is increased.

By using the substrate thickness as a variable, d) capacitance of the line increases as thickness decreases.

In all of the cases above, the line length is expected to be less than $\lambda_g/4$, where $\lambda_g$ is the effective guide wavelength having due regard to the wave velocity of propagation, which is influenced by the substrate material permittivity.

Figure 6:
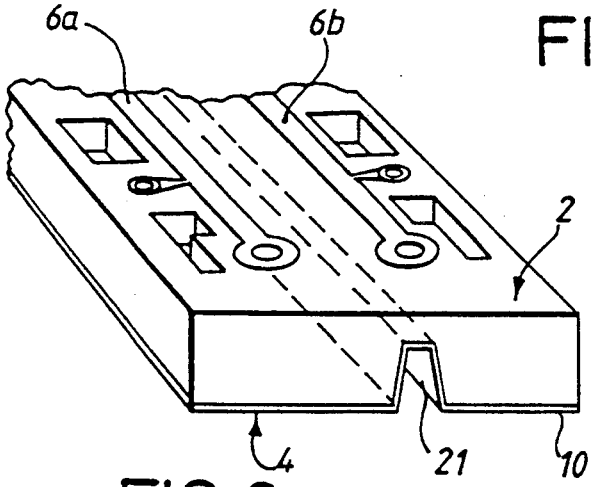
FIG. 6 is a fragmentary perspective view of part of a modified filter.

In an alternative filter embodiment shown in FIG. 6, a groove 21 has been formed in the lower surface 4 of the substrate prior to metallization, parallel to and between the stubs 6*a*, 6*b*. By effectively raising the ground plane between the stubs 6*a*, 6*b*, the coupling between the stubs is reduced which, for a given stub spacing, decreases the bandwidth of the filter. The groove 21 may extend the whole length of the coupled stub section or have a length which is only part of the coupled stub length according to the degree of coupling required by the filter design.

Figure 7:
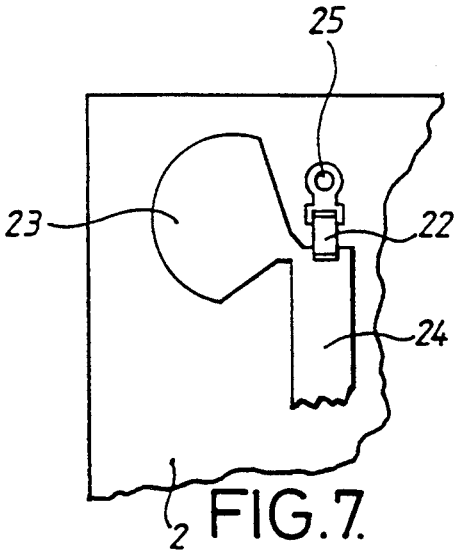
FIG. 7 is a fragmentary plan view of a modified filter using lumped and substrate capacitors in parallel.

For low frequency filters, i.e. those requiring capacitors with values that would need unrealistically large patch areas, a conventional chip type capacitor 22 may be fitted in parallel with a substrate capacitor 23 as shown in FIG. 7. The substrate capacitor 23 may then be trimmed to accommodate tolerance variations in the chip capacitor 22 in order to achieve a desired filter response. The substrate capacitor 23 may be of any arbitrary shape, with some shapes being preferred for their ability to suppress unwanted modes which reduce the upper frequency performance of a filter. Irrespective of the chosen substrate capacitor shape, the capacitance is still determined by selective substrate thinning and the substrate material permittivity. FIG. 7 shows the chip capacitor 22 connected between the end of an inductive stub 24 and a via 25 with the substrate capacitor 23 formed to one side of the chip capacitor 22. This arrangement is given by way of an example only, since other similar arrangements will achieve the same effect.

Figure 8:
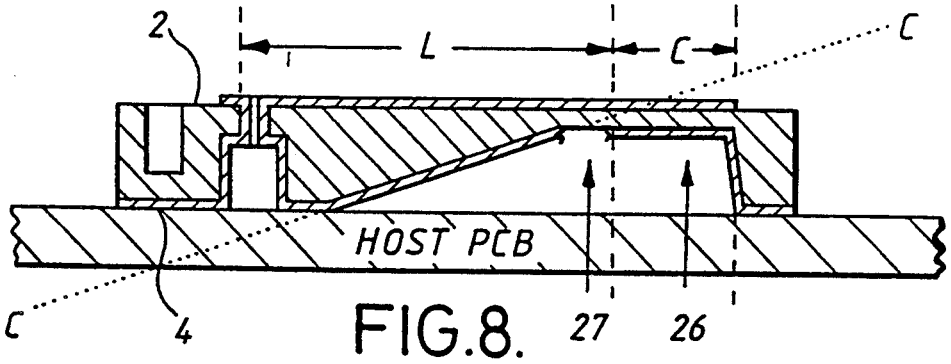
FIG. 8 is a cross section of an alternative filter in accordance with the invention with tapered and parallel selective thinning, shown mounted on a printed circuit board.

In a third embodiment, as shown in FIG. 8, tapered selective thinning is used, along the line C—C, inclined relative to the major faces of the substrate and situated below an inductive element. Using tapered thinning, the frequency at which unwanted modes start to degrade the filter performance is increased, thereby improving filter performance. This embodiment includes inductance (L) and capacitance (C) parallel trimming areas, 27 and 26, which are adjacent each other thus minimising the amount of travel an automated abrasion tool must move to trim both L and C.

Figure 9:
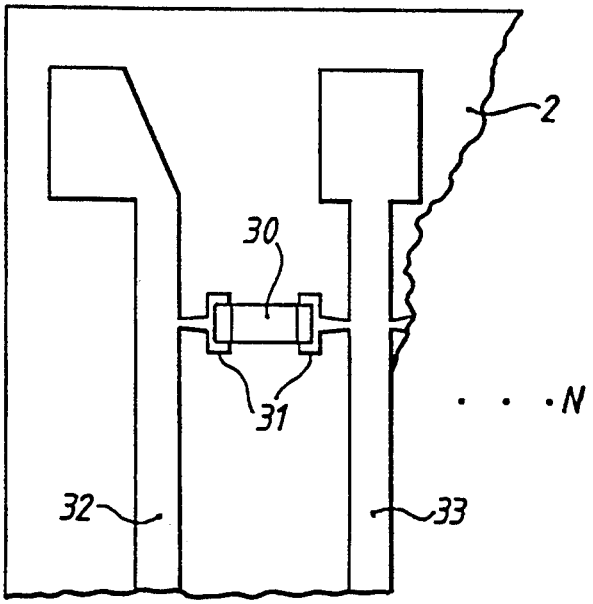
FIG. 9 is a fragmentary plan view of a filter having N coupled lines, showing the general arrangement for adding extra coupling capacitance for producing transmission nulls in the filter response curve.

Referring to the fragmentary view of FIG. 9, an alternative filter in accordance with the invention having N coupled lines includes capacitive coupling between adjacent lines. Such coupling capacitances may be used to introduce transmission nulls into the filter frequency response.

Figure 10:
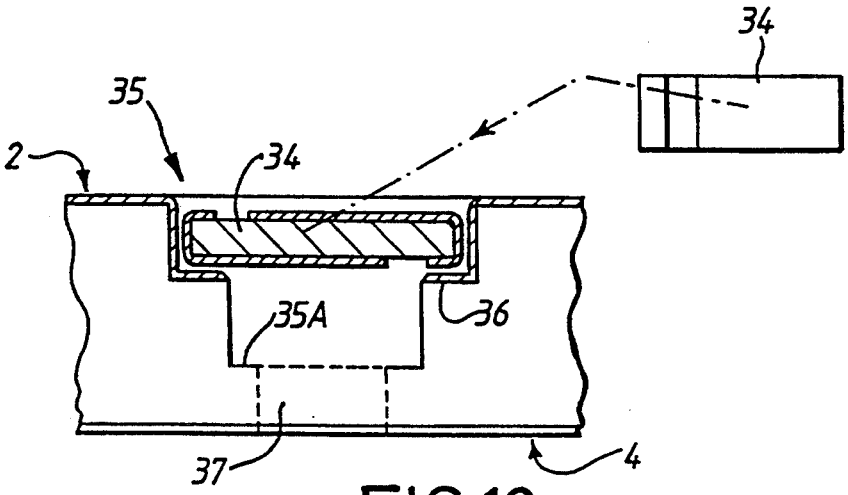
FIG. 10 is a sectional view of a modification of the filter of FIG. 9 which provides for increasing the coupling capacitance and allows trimming of the same coupling capacitance from either the top or bottom surfaces.

For low frequency filters, a standard "chip" type discrete capacitor 30 may be surface mounted on metallized pads 31 linked to adjacent stubs or lines 32, 33. At higher frequencies or where the filter overall thickness must be minimised, a modified version as shown in FIG. 10 is preferable. In this modification a "parallel plate" type discrete capacitor 34 is mounted in a selectively metallized recess 35, metallized shoulders 36 providing the connection to the adjacent coupled lines. Attachment of the capacitor 34 to the metallized recess 35 may be by any preferred bonding method. A further advantage of this embodiment is that metallization may be removed from the surfaces of the capacitor 34 in order to trim the frequency at which a transmission null occurs. This may be done from the upper surface 2 or through an optional slot 37 formed between the floor 35A of the recess 35 and the lower surface 4 of the substrate.

Figure 11:
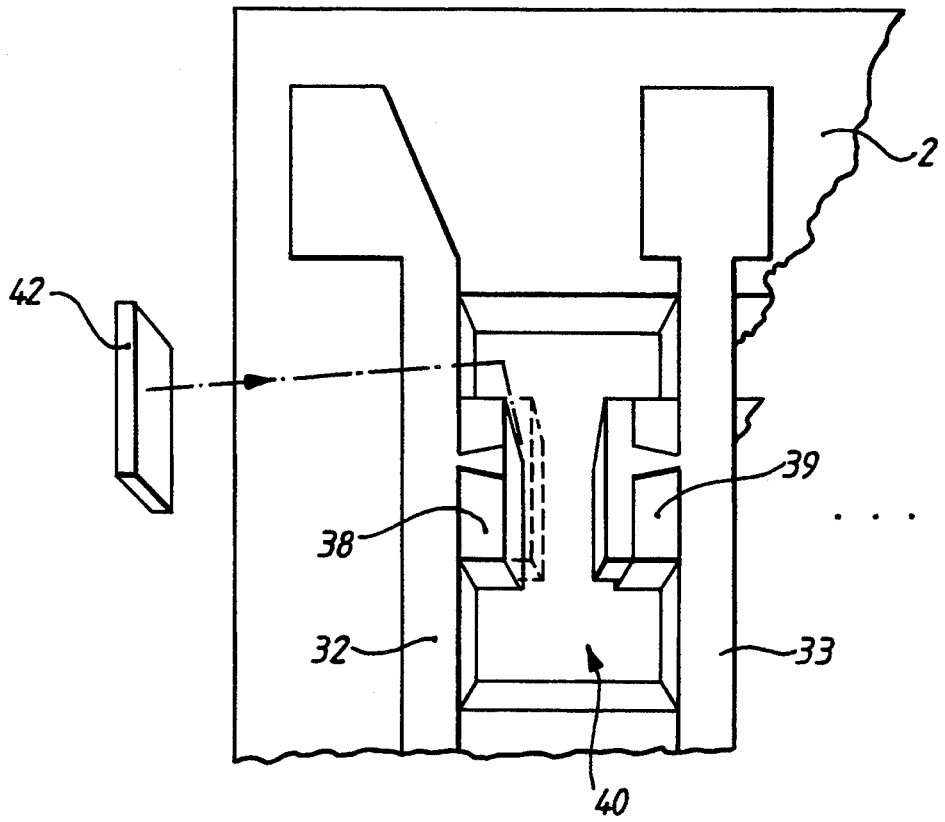
FIG. 11 is a perspective view of an alternative construction viewed from above, showing a coupling capacitance produced without the addition of discrete components.

In a fourth embodiment, as shown in FIG. 11, an "air gap" capacitance has been created by selectively metallizing the opposing faces of blocks 38, 39 formed as projections from opposing sides of a recess 40 in the upper surface 2, between adjacent stubs 32, 33 during the thinning process. This type of capacitance has a very high "Q" value and is well suited to very high frequency applications. The value of this capacitance may be adjusted (a) by changing the surface area of the opposing faces and/or the depth of the blocks 38, 39, thus bringing the opposing faces closer together, or (b) by having conducting tabs 42 of varying thicknesses bonded to the opposing faces of the blocks 38, 39 to alter the air gap between the blocks and thus change the added coupling capacitance. The conducting tabs 42 may be constructed from either ferromagnetic or non-ferromagnetic material.

Figure 12:
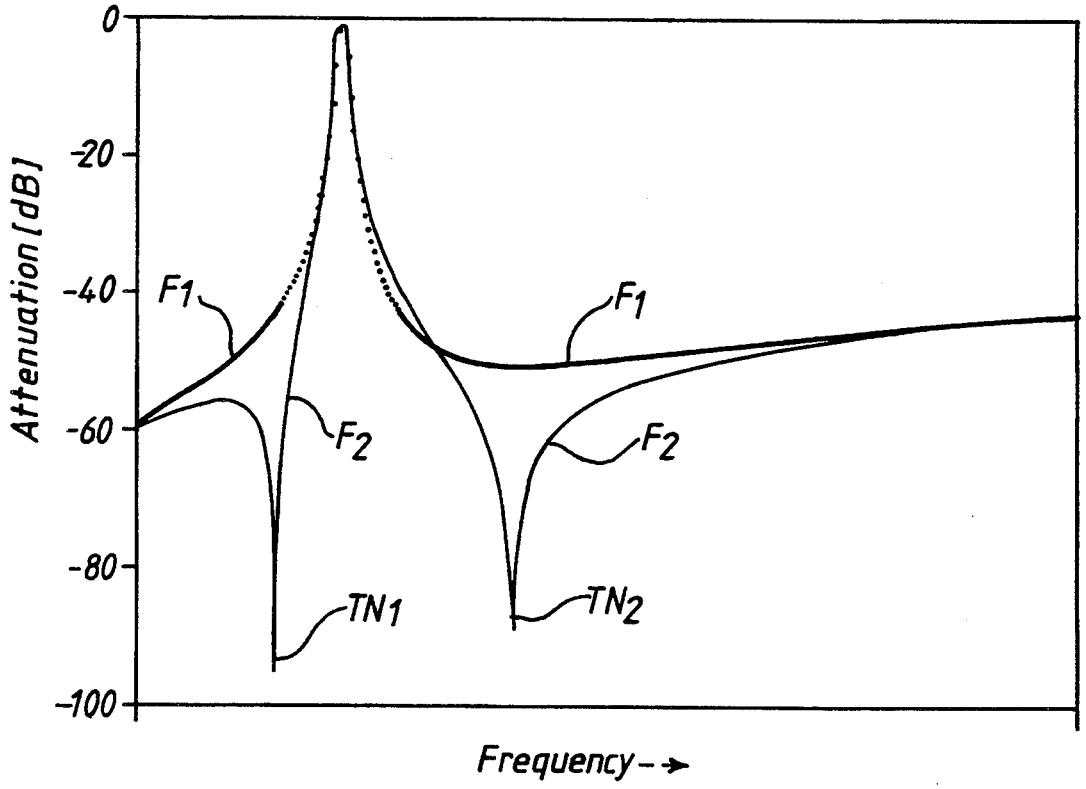
FIG. 12 is a plot of transmission attenuation ($S_{21}$) versus frequency for the filter of FIG. 1 and, for comparison, a plot of the same variables for a modified embodiment.

Referring to FIG. 12, which shows a plot of transmission versus frequency for the filter of FIG. 1 (thick dotted line marked F1) and a plot of a modified filter using coupling capacitances (marked F2), it may be seen that transmission nulls TN1 and TN2 can be made to occur on either side of the passband in the F2 plot. Such nulls will be familiar to those skilled in the art of filter design as being characteristic of elliptic function or Cauer filters. The use of transmission zeros in such filters allows the sharpest transition from passband to stopband that is theoretically possible for a given number of filter poles.

The embodiments described above with reference to FIGS. 9 to 11 allow the filter designer to increase the capacitive coupling between adjacent lines. For the example shown in FIG. 1 the transmission response of the filter having the curve F1 is transformed into that of F2 when the capacitive coupling is increased typically by less than one picofarad, using one of the techniques of FIGS. 9–11. The advantage of employing such transmission zeros is that for a given attenuation requirement near the passband, the filter will need less resonators thus resulting in a smaller filter than would otherwise be possible.

With a filter of the type shown in FIG. 1, using only one pair of coupled lines, the filter designer may choose the additional coupling capacitance value to place a single transmission null above or below the pass-band. For the case of N coupled lines the filter designer may choose between making selected nulls wider for a given attenuation value or providing multiple nulls according to the filter application requirements.

In each of the filter embodiments described above, the substrate thickness is typically in the range of from 2 mm to 8 mm and the portions of lesser thickness may be in the region of 0.1 mm to 2 mm, and typically 0.1 mm to 0.3 mm.

In summary, the techniques described above yield a compact transmission line filter and give the designer the ability to adjust capacitance and inductance values. They allow for the possibility of variously shaped capacitors, a plated "anti-coupling" or shielding groove between adjacent transmission line sections, the addition of a discrete or monolithic capacitor or capacitors between non-ground nodes, e.g. to generate transmission nulls in the filter response, and the suppression of unwanted "modes" by tapered inductor construction. In addition, material may be removed from the substrate near inductive lines, coupled or otherwise, and metallic "tabs" may be used to tune transmission nulls, the tabs being ferromagnetic or non-ferromagnetic. The substrate may be housed in a shielding can or in a metallized dielectric material cover which may also be recessed.

It has been mentioned above that an amplifier may be incorporated on the substrate in conjunction with filter components. Associated with an amplifier device may be matching components such as capacitive stubs, and these stubs may be reduced in size using lesser thickness portions of the substrate in registry with metallized stub areas in the manner described above. Indeed, the capacitance values of the stubs may be trimmed by removal of parts of the metallisation as described above.

Such techniques are equally suitable for application in strip-line circuits.

What is claimed is:

1. A radio frequency filter comprising:

an electrically insulative substrate substantially in the form of a plate of dielectric material;

an electrically conductive ground plane formed on a first major face of said plate of dielectric material;

a metallization pattern formed on a second major face of said plate of dielectric material;

wherein said metallization pattern, said plate of dielectric material and said electrically conductive ground plane conjoin to form a plurality of interconnected reactive elements;

wherein said plate of dielectric material has a portion of lesser thickness in a region of a part of said metallization pattern associated with at least one of the reactive elements, said metallization pattern and said electrically conductive ground plane being closer together in said region than in other portions of said plate of dielectric material;

said plurality of interconnected reactive elements comprise a plurality of transmission line resonators providing a coupled line filter, each transmission line resonator comprising an inductance and a capacitance;

each inductance comprising a transmission line inductance of less than $\lambda_g/4$ in length, where $\lambda_g$ is an operating wavelength of said radio frequency filter; and said electrically conductive ground plane has a non-conductive trimming break portion in a region where said first major face is recessed.

2. A filter according to claim 1, wherein said metallization pattern includes at least one capacitor plate forming, in conjunction with said electrically conductive ground plane, said capacitance, and wherein said plate of dielectric material has a portion of lesser thickness in between said capacitor plate and said electrically conductive ground plane.

3. A filter according to claim 1, wherein said plate of dielectric material has a portion of lesser thickness between said transmission line inductance and said electrically conductive ground plane.

4. A filter according to claim 3, wherein said transmission line inductance constitutes a transmission line section having a proximal end connected to a capacitor plate and a distal end connected to said electrically conductive ground plane by means of a via, the via being located in said portion of lesser thickness.

5. A filter according to claim 1, wherein said portion of lesser thickness is formed by a recess in said first major face of said plate of dielectric material said electrically conductive ground plane extending into said recess.

6. A filter according to claim 1, wherein said plate of dielectric material has a portion of lesser thickness by a recess having a face which is inclined relative to said second major face of said plate of dielectric material.

7. A filter according to claim 1, wherein said second major face of said plate of dielectric material is enclosed in a shield comprising at least a metal can and a cover of metallized dielectric material.

8. A filter according to claim 7, wherein said shield has at least one recessed area which brings said shield closer to said second major face off said plate of dielectric material rather than the remainder of the shield.

9. A filter according to claim 7, wherein said plate of dielectric material has at least one other portion of lesser thickness in an area not between a part of said metallization pattern associated with one of said plurality of interconnected reactive elements and said electrically conductive ground plane.

10. A filter according to claim 1, constructed as a monolithic device.

11. A filter according to claim 1, having a plurality of vias connecting said metallization pattern and said electrically conductive ground plane.

12. A filter according to claim 11, wherein said vias serve to couple said transmission line inductances to said electrically conductive ground plane.

13. A filter according to claim 2, wherein at least one of said capacitor plates is located at an end of a respective transmission line inductance.

14. A filter according to claim 1, wherein said plate of dielectric material includes at least one separate area of lesser thickness situated between at least one pair of adjacent transmission line inductances.

15. A filter according to claim 14, wherein said at least one separate area of lesser thickness is formed by a groove between said adjacent transmission line inductances, said groove being formed in said second major face.

16. A filter according to claim 1, wherein said plate of dielectric material includes means for mounting electrical components for connecting said filter.

17. A filter according to claim 1, wherein said dielectric material is a ceramic material.

18. A filter according to claim 1, having at least one pair of adjacent inductive transmission line inductances electromagnetically coupled together.

19. A filter according to claim 18, wherein said coupling is achieved by mounting at least one discrete capacitor component between said adjacent inductances.

20. A filter according to claim 18, wherein said coupling is achieved by forming a recess between said adjacent transmission line inductances and located in the same face of said plate of dielectric material as said transmission line inductances, said recess having a pair of conductive faces each electrically coupled to a respective one of said adjacent transmission line inductances, said conductive faces cooperating to form a capacitor coupling said adjacent transmission lines.

21. A filter according to claim 20, having at least one conductive tab bonded to at least one of said recess faces.

22. A filter according to claim 1, having a capacitor plate and wherein said non-conductive trimming break portion in said electrically conductive ground plane is between said capacitor plate and said electrically conductive ground plane.

23. A method of manufacturing a radio frequency filter comprising:

forming from a dielectric material an electrically insulative substrate substantially in the form of a plate with at least one recess in a first major face thereof;

depositing on said first major face a metallization layer to form a ground plane;

depositing on a second major face of said plate a metallization pattern, said metallization pattern, said plate of dielectric material and said ground plane cojoining to form a plurality of interconnected reactive elements;

wherein said ground plane extends into at least one recess;

wherein said plurality of interconnected reactive elements comprise a plurality of transmission line resonators providing a coupled line filter, each transmission line resonator comprising an inductance and a capacitance; and each of said inductances comprising a transmission line inductance less than $\lambda_g/4$ in length, where $\lambda_g$ is an operating wavelength of said radio frequency filter; and trimming the value off one of said reactive elements by removing a portion of said ground plane at the location of a recess.

24. A method according to claim 23, wherein said recess is formed by removing material from an unrecessed plate of dielectric material, said ground plane being formed after the removing step.

25. A method according to claim 23, including forming at least one plated via between said ground plane and said metallization pattern.

26. A method according to claim 23, including trimming the value of said reactive element by removing a portion of at least on of the ground plane and the metallization pattern at the location of a respective recess.

* * * * *